US009729975B2

(12) United States Patent
Bojesen et al.

(10) Patent No.: US 9,729,975 B2
(45) Date of Patent: Aug. 8, 2017

(54) APPARATUS FOR TESTING DIRECTIONALITY IN HEARING INSTRUMENTS

(71) Applicant: Natus Medical Incorporated, San Carlos, CA (US)

(72) Inventors: Ask Bojesen, Kobenhavn NV (DK); Michael Ekelid, Allerod (DK)

(73) Assignee: Natus Medical Incorporated, San Carlos, CA (US)

( * ) Notice: Subject to any disclaimer, the term of this patent is extended or adjusted under 35 U.S.C. 154(b) by 0 days.

(21) Appl. No.: 14/311,974

(22) Filed: Jun. 23, 2014

(65) Prior Publication Data

US 2015/0373462 A1 Dec. 24, 2015

(30) Foreign Application Priority Data

Jun. 20, 2014 (DK) ..... 2014 70370
Jun. 20, 2014 (EP) ..... 14173217

(51) Int. Cl.
*H04R 29/00* (2006.01)
*H04R 25/00* (2006.01)

(52) U.S. Cl.
CPC ..... *H04R 25/30* (2013.01); *H04R 25/405* (2013.01)

(58) Field of Classification Search
CPC ..... G01H 1/0083; H04R 25/30; H04R 25/405
See application file for complete search history.

(56) References Cited

U.S. PATENT DOCUMENTS 5,703,797 A 12/1997 Russell
7,062,056 B2 6/2006 Jonkman
8,855,341 B2 * 10/2014 Kim ..... H04R 3/005 381/122
2005/0053250 A1 3/2005 Jonkman
2005/0259829 A1 11/2005 Van Den Heuvel et al.
2006/0050911 A1 3/2006 Von Buol
2007/0175281 A1 8/2007 Klemenz et al.
2007/0286429 A1 12/2007 Grafenberg et al.
2012/0300964 A1 * 11/2012 Ku ..... A61B 5/04845 381/321

OTHER PUBLICATIONS

Extended European Search Report dated Dec. 10, 2014, for related European Patent Application No. EP 14173217.2, 7 pages.

(Continued)

*Primary Examiner* — Andrew L Sniezek
(74) *Attorney, Agent, or Firm* — Temmerman Law Office; Mathew J. Temmerman

(57) ABSTRACT

An apparatus for testing a directional hearing instrument includes: a first microphone for coupling with an output of the hearing instrument, wherein the first microphone is configured to receive an audio output signal from the hearing instrument; a first speaker for transmission of a first signal having a first frequency component at a first frequency; a second speaker for transmission of a second signal having a second frequency component at a second frequency; and a processing unit configured to determine one or more hearing instrument parameters based on cross spectrum analysis of the first signal and the audio output signal.

21 Claims, 7 Drawing Sheets

(56) References Cited

OTHER PUBLICATIONS

T. Schneider, et al., "A Dual-Channel MLS-Based Test System for Hearing-Aid Characterization", Journal of the Audio Engineering Society, Audio Engineering Society, New York, NY, US. vol. 41, No. 7/08, Jul. 1, 1993, 12 pages.
Steven L. Bell, "Filtering to Match Hearing Aid Insertion Gain to Individual Ear Acoustics", Trends in Amplification, vol. 13, No. 3, Aug. 26, 2009, 10 pages.
Roxanne Kohilakis, "Evaluation of Directional Microphone Drift in Digital Hearing Aids" May 17, 2013, 32 pages.
Andrew B. Dittberner, "Quantifying microphone directivity", Hearing Journal, Laux Co., Harvard, MA, US, vol. 56, No. 11, Nov. 1, 2003, 4 page.
First Technical Examination and Search Report dated Jan. 23, 2015, for related Danish patent Application No. PA 2014 70370, 6 pages.

* cited by examiner

APPARATUS FOR TESTING DIRECTIONALITY IN HEARING INSTRUMENTS

RELATED APPLICATION DATA

This application claims priority to, and the benefit of, Danish Patent Application No. PA 2014 70370, filed on Jun. 20, 2014, pending, and European Patent Application No. 14173217.2, filed on Jun. 20, 2014, pending. The entire disclosures of both of the above applications are expressly incorporated by reference herein.

FIELD

The present disclosure relates to apparatus for testing a hearing instrument and method related thereto and in particular to an apparatus for testing directionality of a hearing instrument.

BACKGROUND

Many modern hearing instruments include signal processing which allows the hearing instrument to amplify the sound arriving from one direction (typically from the front of the hearing instrument user), while attenuating the sound from other directions. A simple test to verify this functionality will present pure tones at various frequencies, from the front of the hearing instrument and from another direction, in two separate measurements.

This type of test will work well if the hearing instrument is working in a simple mode where the amplification is nearly independent of the type of signals presented to its microphone(s).

However, with the recent development of advanced hearing instruments, the signal processing functions in the hearing instrument may include adaptation to the received signal. Specifically, one type of algorithm may detect the presence or absence of speech in the microphone signal(s), and process the signal(s) in order to optimize speech perception for the hearing instrument user. Such an algorithm may classify pure tone signals as non-speech or noise and suppress the signals, leading to an incorrect measurement of the directionality characteristics.

Attempts to avoid the suppression of the directionality test signal have been described in the literature, e.g. by presenting simultaneous tones over a broad spectrum, some hearing instrument algorithms are more likely to detect the test signal as "speech" and thereby allow for a test of directionality.

Although this method may be effective in some situations, the trend towards more advanced speech processing algorithms in hearing instruments leads to a desire to use natural signals as stimuli.

SUMMARY

There is a need for an apparatus and method for testing directionality of a hearing instrument using natural signals, such as speech, traffic noise, cocktail party noise etc. Furthermore, it is desirable to be able to present signals from more directions of the hearing instrument simultaneously to allow the hearing instrument algorithms to perform as intended.

Accordingly, an apparatus for testing a directional hearing instrument is provided. The apparatus comprises: a first microphone for coupling with an output of the hearing instrument; a first speaker for transmission of a first signal; and a second speaker for transmission of a second signal. The apparatus is configured to: transmit the first signal, the first signal having a first frequency component at a first frequency; transmit the second signal, the second signal having a second frequency component at a second frequency; receive an audio output signal from the hearing instrument; and determine one or more hearing instrument parameters based on cross spectrum analysis of the first signal and the audio output signal.

Also disclosed is a method for testing a directional hearing instrument. The method comprises: transmitting a first signal through a first speaker, the first signal having a first frequency component at a first frequency; transmitting a second signal through a second speaker the second signal having a second frequency component at a second frequency; receiving an audio output signal from the hearing instrument; and determining one or more hearing instrument parameters based on cross spectrum analysis of the first signal and the audio output signal.

It is an advantage that it provides a high degree of freedom in the choice of test signals, i.e. the first signal and the second signal (e.g. front and back). Hence, in accordance with some embodiments described herein, test signals resembling real life situations may be chosen, and any suppression of artificial test signals may be avoided, and the directionality of the hearing instrument may be tested in situations as will be experienced by the end user.

The method for testing a directional hearing instrument may be incorporated in the apparatus as also disclosed. Furthermore any elements or procedural steps as described in connection with any one aspect may be used with any other aspects or embodiments, mutatis mutandis.

An apparatus for testing a directional hearing instrument includes: a first microphone for coupling with an output of the hearing instrument, wherein the first microphone is configured to receive an audio output signal from the hearing instrument; a first speaker for transmission of a first signal having a first frequency component at a first frequency; a second speaker for transmission of a second signal having a second frequency component at a second frequency; and a processing unit configured to determine one or more hearing instrument parameters based on cross spectrum analysis of the first signal and the audio output signal.

Optionally, the processing unit is configured to determine the one or more hearing instrument parameters also based on cross spectrum analysis of the second signal and the audio output signal.

Optionally, a difference between the first frequency and the second frequency is less than 10 Hz.

Optionally, the one or more hearing instrument parameters comprise a first hearing instrument parameter, the first hearing instrument parameter being a front-to-back ratio.

Optionally, a ratio or a difference between the first frequency component and the second frequency component is anywhere from 0.2 to 5.

Optionally, the one or more hearing instrument parameters comprise a first transfer function that is based on the first signal and the audio output signal.

Optionally, the one or more hearing instrument parameters comprise a second transfer function that is based on the second signal and the audio output signal.

Optionally, the processing unit is configured to perform a dual channel DFT of the first signal and the audio output signal and/or of the second signal and the audio output signal.

Optionally, the first signal and the second signal are at least partly separate in time.

Optionally, the first signal comprises an International Speech Test Signal.

A method for testing a directional hearing instrument includes: transmitting a first signal through a first speaker, the first signal having a first frequency component at a first frequency; transmitting a second signal through a second speaker, the second signal having a second frequency component at a second frequency; receiving an audio output signal from the hearing instrument; and determining one or more hearing instrument parameters based on cross spectrum analysis of the first signal and the audio output signal.

Optionally, the one or more hearing instrument parameters are determined also based on cross spectrum analysis of the second signal and the audio output signal Optionally, a difference between the first frequency and the second frequency is less than 10 Hz.

Optionally, the one or more hearing instrument parameters comprise a first hearing instrument parameter, the first hearing instrument parameter being a front-to-back ratio.

Optionally, the front-to-back ratio is based on a first transfer function and a second transfer function, wherein the first transfer function is based on the first signal and the audio output signal, and the second transfer function is based on the second signal and the audio output signal.

Other and further aspects and features will be evident from reading the following detailed description.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
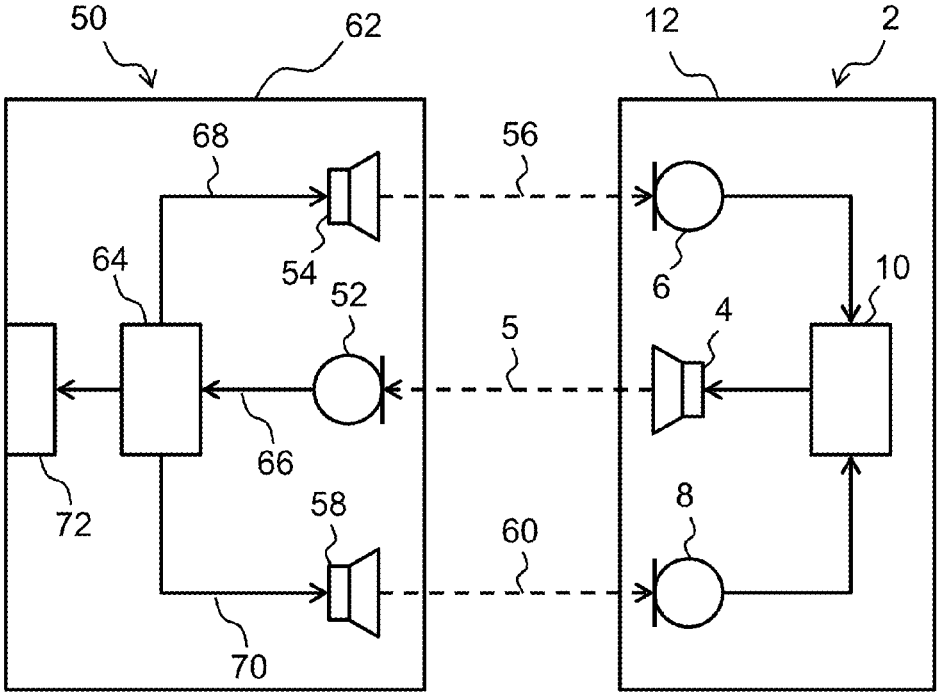
FIG. 1 schematically illustrates an exemplary apparatus for testing a directional hearing instrument, FIG. 2 schematically illustrates an exemplary processing unit for an exemplary apparatus for testing a directional hearing instrument.

Various features are described hereinafter with reference to the figures. It should be noted that the figures may or may not be drawn to scale and that the elements of similar structures or functions are represented by like reference numerals throughout the figures. It should be noted that the figures are only intended to facilitate the description of the features. They are not intended as an exhaustive description of the claimed invention or as a limitation on the scope of the claimed invention. In addition, an illustrated feature needs not have all the aspects or advantages shown. An aspect or an advantage described in conjunction with a particular feature is not necessarily limited to that feature and can be practiced in any other features even if not so illustrated or if not so explicitly described.

The first signal may be directed towards a first input transducer of the hearing instrument, such as a front input transducer of the hearing instrument. The second signal may be directed towards a second input transducer of the hearing instrument, such as a rear input transducer of the hearing instrument. The first speaker may be configured for transmitting the first signal towards the first input transducer of the hearing instrument, such as the front input transducer of the hearing instrument. The second speaker may be configured for transmitting the second signal towards the second input transducer of the hearing instrument, such as the rear input transducer of the hearing instrument.

The first signal and/or the second signal may be a speech signal. The first signal and/or the second signal may be a speech signal in a language such as English, Danish, German, French, Arabic, Chinese, Japanese, Spanish. The first signal and/or the second signal may be the International Speech Test Signal (ISTS). ISTS is an internationally recognized test signal based on natural recordings of speech. The ISTS reflects a female speaker for six different mother tongues (American English, Arabic, Chinese, French, German, and Spanish).

The first signal and/or the second signal may be a noise signal. The first signal and/or the second signal may be a random noise signal. The first signal and/or the second signal may be a random noise signal with a characteristic power spectrum, e.g. flat, decaying, increasing, and/or variable over a range of frequencies. For example, the first signal and/or the second signal may be white noise, pink noise, Brownian noise, blue noise, violet noise, grey noise.

The first and/or the second signal may be a natural sounding noise signal, e.g. a mix of other speech signals, traffic noise. The first signal and/or the second signal may be a noise signal comprising a plurality of speech signals, e.g. the first signal and/or the second signal may be cocktail party noise and/or a babble noise.

In an exemplary apparatus and/or method, the first signal is a speech signal, e.g. the ISTS, and the second signal is a noise signal, e.g. a random noise signal and/or a natural sounding noise signal.

Transmission of the second signal, or transmission of a second part of the second signal, may be simultaneous with transmission of the first signal, or transmission of a first part of the first signal. Simultaneous transmission of the first signal and the second signal may decrease test time and/or increase quality of the test since the hearing instrument is subjected to a situation resembling a real life situation. Accordingly, the first and second signal may have an overlap in time. For example, the first signal and the second signal may overlap in one or more overlap periods. An overlap period, e.g. a first overlap period, may have a duration of at least 2 seconds.

The first microphone may be a directional microphone. The first microphone may be shielded to avoid receiving sound transmitted from the first and/or second speakers. The coupling of the first microphone with the output of the hearing instrument may be obtained by providing an acoustic tube between the first microphone and the output of the hearing instrument. Provision of an acoustic tube between the output of the hearing instrument and the first microphone may avoid or decrease reception of sound transmitted from the first speaker and/or second speaker.

The apparatus may be configured to perform a cross spectrum analysis of the first signal and the audio output signal. The apparatus may be configured to perform a cross spectrum analysis of the second signal and the audio output signal.

Determining one or more hearing instrument parameters may be based on cross spectrum analysis of the second signal and the audio output signal. Determining one or more hearing instrument parameters may be based on cross spectrum analysis of the first signal and the audio output signal and cross spectrum analysis of the second signal and the audio output signal.

The apparatus may be configured to determine one or more hearing instrument parameters based on cross spectrum analysis of the second signal and the audio output signal. The apparatus may be configured to determine one or more hearing instrument parameters based on cross spectrum analysis of the first signal and the audio output signal and cross spectrum analysis of the second signal and the audio output signal.

The apparatus may be configured to obtain a power spectrum of the first signal and/or the second signal and/or the audio output signal. The apparatus may be configured to obtain a cross spectrum of the first signal and the audio output signal. The apparatus may be configured to obtain a cross spectrum of the second signal and the audio output signal.

Power spectrum and/or cross spectrum of a signal, such as the first signal and/or the second signal and/or the audio output signal and/or any combinations hereof, may be obtained by cross spectrum analysis.

The first signal has a first frequency component at a first frequency, and the second signal has a second frequency component at a second frequency. The difference between the first frequency and the second frequency may be less than 10 Hz, such as less than 5 Hz, such as less than 1 Hz. The first signal and the second signal may have overlapping frequency components, such as the first frequency component and the second frequency component. The first frequency and the second frequency may be the same frequency, or substantially the same frequency.

The frequency components, such as the first frequency component and/or the second frequency component, may have a certain magnitude. The frequency components, such as the first frequency component and/or the second frequency component, may have a certain magnitude relative to each other. The magnitude of the frequency components may be measured in units of decibel sound pressure level (dBSPL). A relationship, such as a ratio and/or a difference, between the first frequency component, e.g. measured in dBSPL, and the second frequency component, e.g. measured in dBSPL, may be in the range from 0.2 to 5.

The one or more hearing instrument parameters may comprise a first hearing instrument parameter and/or a second hearing instrument parameter and/or a third hearing instrument parameter. The one or more hearing instrument parameters may comprise a plurality of hearing instrument parameters comprising the first hearing instrument parameter and/or the second hearing instrument parameter and/or the third hearing instrument parameter.

The one or more hearing instrument parameters may comprise a first transfer function. The first transfer function may be based on the first signal and the audio output signal.

The first hearing instrument parameter and/or the second hearing instrument parameter and/or the third hearing instrument parameter may be the first transfer function. The first transfer function may be a front-to-output transfer function of the hearing instrument. A front-to-output frequency response of the hearing instrument may be obtained based on the first transfer function.

The one or more hearing instrument parameters may comprise a second transfer function. The second transfer function may be based on the second signal and the audio output signal.

The first hearing instrument parameter and/or the second hearing instrument parameter and/or the third hearing instrument parameter may be the second transfer function. The second transfer function may be a rear-to-output transfer function of the hearing instrument. A rear-to-output frequency response of the hearing instrument may be obtained based on the second transfer function.

The first transfer function and/or second transfer function may be obtained using dual channel DFT, such as dual channel FFT analysis. Dual channel DFT comprises cross spectrum analysis. The first transfer function may be obtained using dual channel DFT of the first signal and the audio output signal. The second transfer function may be obtained using dual channel DFT of the second signal and the audio output signal. The apparatus may be configured to perform a dual channel DFT of the first signal and the audio output signal. Additionally or alternatively, the apparatus may be configured to perform a dual channel DFT of the second signal and the audio output signal.

The one or more hearing instrument parameters may comprise a front-to-back ratio. The front-to-back ratio may be based on the first transfer function and the second transfer function. The front-to-back ratio may be based on the first transfer function and the second transfer function, wherein the first transfer function may be based on the first signal and the audio output signal and the second transfer function may be based on the second signal and the audio output signal. The front-to-back ratio may be a ratio of the first transfer function and the second transfer function.

The first hearing instrument parameter and/or the second hearing instrument parameter and/or the third hearing instrument parameter may be the front-to-back ratio.

The first signal and the second signal may be at least partly separate in time. The first signal and the second signal may have one or more instances during transmission where they are indistinguishable. However, over time the first signal and the second signal are distinguishable, i.e. the first signal and the second signal has one or more instances during transmission where they are distinguishable.

The first signal and the second signal may be very different, e.g. in contents of frequency components and/or time variation. For example, the cross correlation (time lag=0) between the first signal and the second signal may be less than a first threshold. Thus, determining of one or more hearing instrument parameters may be performed with short test signals and/or short test time.

The first signal and the second signal may be very similar, e.g. less different, e.g. in contents of frequency components and/or time variation. For example, the cross correlation (time lag=0) between the first signal and the second signal may be larger than a second threshold. Similarity of the first signal and the second signal may follow from using natural signals. However, the first signal and the second signal may be different in at least a plurality of instances during the test duration, such as the complete duration of the first signal and/or second signal. For example, the first signal may be a speech signal and the second signal may be a noise signal, e.g. a noise signal comprising a plurality of speech signals.

The first signal may be a finite signal with a first duration. The second signal may be a finite signal with a second duration. The first duration and/or the second duration may be between 1-30 seconds, such as between 5-20 seconds, such as between 10-15 seconds. The first duration and the second duration may be the same, or substantially the same. The first duration and the second duration may differ by less than 3 second, such as less than 2 seconds, such as less than 1 second.

Cross spectrum analysis of the first signal and the audio output signal and/or cross spectrum analysis of the second signal and the audio output signal may comprise segmenting the first signal and/or the second signal and/or the audio output signal in a plurality of segments. The segments, e.g. each of the plurality of the segments or a group of segments may have durations between 10-400 ms, such as between 30-300 ms, such as between 50-200 ms, such as between 70-150 ms. The segments, e.g. each of the plurality of the segments or a group of segments, may have the same duration.

Cross spectrum analysis of the first signal and the audio output signal and/or cross spectrum analysis of the second signal and the audio output signal may comprise averaging over cross spectrum analysis of a plurality of segments of the first signal and/or the second signal and/or the audio output signal.

FIG. 1 schematically illustrates an exemplary apparatus 50 for testing a directional hearing instrument 2. The apparatus 50 comprises: a first microphone 52 for coupling with an output 4 of the hearing instrument 2; a first speaker 54 for transmission of a first signal 56; and a second speaker 58 for transmission of a second signal 60.

A directional hearing instrument, such as the directional hearing instrument 2 as illustrated, comprises a first input transducer 6, a second input transducer 8, an output 4, and a hearing instrument processing unit 10. The first input transducer 6 and the second input transducer 8 is typically positioned to primarily detect acoustic signals from opposite or approximately opposite directions. For example, the first input transducer 6 may be a front input transducer, and the second input transducer 8 may be a rear input transducer. The directional hearing instrument 2 furthermore comprises a hearing instrument housing 12. The first input transducer 6, the second input transducer 8, the output 4, and the hearing instrument processing unit 10 are contained in the hearing instrument housing 12.

The first speaker 54 transmits the first signal 56 towards the first input transducer 6 of the hearing instrument 2. The second speaker 58 transmits the second signal 60 towards the second input transducer 8 of the hearing instrument 2. The first input transducer 6 may detect the second signal 60, or a fraction of the second signal 60. The second input transducer 8 may detect the first signal 56, or a fraction of the first signal 56.

The apparatus 50 is configured to: transmit the first signal 56, transmit the second signal 60, and receive an audio output signal 5 from the hearing instrument 2. The first signal 56 and the second signal 60 are acoustic signals. The first signal has a first frequency component at a first frequency, and the second signal has a second frequency component at a second frequency. The first frequency and the second frequency may be the same and/or overlapping, e.g. the difference between the first frequency and the second frequency may be less than 10 Hz. The first signal 56 and the second signal 60 may comprise contents at one or more common frequencies. A relationship, such as a ratio or difference, between the first frequency component and the second frequency component measured in sound pressure, such as dBSPL, may be in the range from 0.1 to 20, such as in the range from 0.1 to 10, such as in the range from 0.2 to 5.

The apparatus 50 may transmit the first signal 56 from the first speaker 54 simultaneously, or within less than 5 ms, such as within less than 1 ms, of transmitting the second signal 60 from the second speaker 58. The first signal 56 and the second signal 60 may be different over time. For example, the first signal 56 and the second signal 60 may have one or more instances during transmission where they are indistinguishable, but over time they are distinguishable, i.e. the first signal 56 and the second signal 60 has one or more instances during transmission where they are distinguishable.

The apparatus 50 is furthermore configured to determine one or more hearing instrument parameters based on cross spectrum analysis of the first signal 56 and the audio output signal 5. The apparatus 50 may furthermore be configured to determine one or more hearing instrument parameters based on cross spectrum analysis of the second signal 60 and the audio output signal 5.

The apparatus 50 furthermore comprises an apparatus processing unit 64. The apparatus processing unit 64 is connected to the first microphone 52, the first speaker 54, and the second speaker 58. The apparatus processing unit 64 receives, from the first microphone 52 an input signal 66 indicative of the audio output signal 5 of the hearing instrument 2.

The apparatus processing unit 64 may be configured to determine the one or more hearing instrument parameters. Furthermore, the apparatus processing unit 64 may be configured to control the first speaker 54 to transmit the first signal 56 by transmitting a first speaker signal 68 indicative of the first signal 56, and/or the apparatus processing unit 64 may be configured to control the second speaker 58 to transmit the second signal 60 by transmitting a second speaker signal 70 indicative of the second signal 60.

The one or more hearing instrument parameters may comprise a first transfer function based on the first signal 56 and the audio output signal 5. The first transfer function may be based on cross spectrum analysis of the first signal 56 and the audio output signal 5.

The one or more hearing instrument parameters may comprise a second transfer function based on the second signal 60 and the audio output signal 5. The second transfer function may be based on cross spectrum analysis of the second signal 60 and the audio output signal 5.

The one or more hearing instrument parameters may be a front-to-back ratio (sometimes also referred to as a front-to-rear ratio), e.g. a ratio of the first signal 56 and the second signal 60 in the received audio output signal 5. The front-to-back ratio may be determined from a ratio of a cross spectrum analysis of the first signal 56 and the audio output signal 5 and a cross spectrum analysis of the second signal 60 and the audio output signal 5. The front-to-back ratio may be determined by a ratio between the first transfer function and the second transfer function.

The apparatus 50 comprises an apparatus housing 62. The housing 62 comprise the first microphone 52, the first speaker 54, and the second speaker 58. In the apparatus 50, as depicted, the apparatus housing comprises the processing unit 64. In other exemplary apparatuses (not shown), the processing unit 64 may be external to the apparatus housing 62, e.g. the processing unit 64 may be a processing unit of a laptop, a smartphone, a tablet computer, or any other device.

The apparatus 50 further comprises an optional interface 72 for providing an output to a user or an additional device. The interface 72 may be a display, a wireless transmitter unit, an interface speaker, and/or a connector. The wireless transmitter may be a Bluetooth transmitter, a WiFi transmitter, a 3G transmitter, and/or a 4G transmitter. The connector may be a USB connector, a FireWire connector, and/or a custom connector. The interface 72 may connect the apparatus to an external device, such as a laptop, a smart phone, a tablet computer, and/or a PC.

Figure 2:
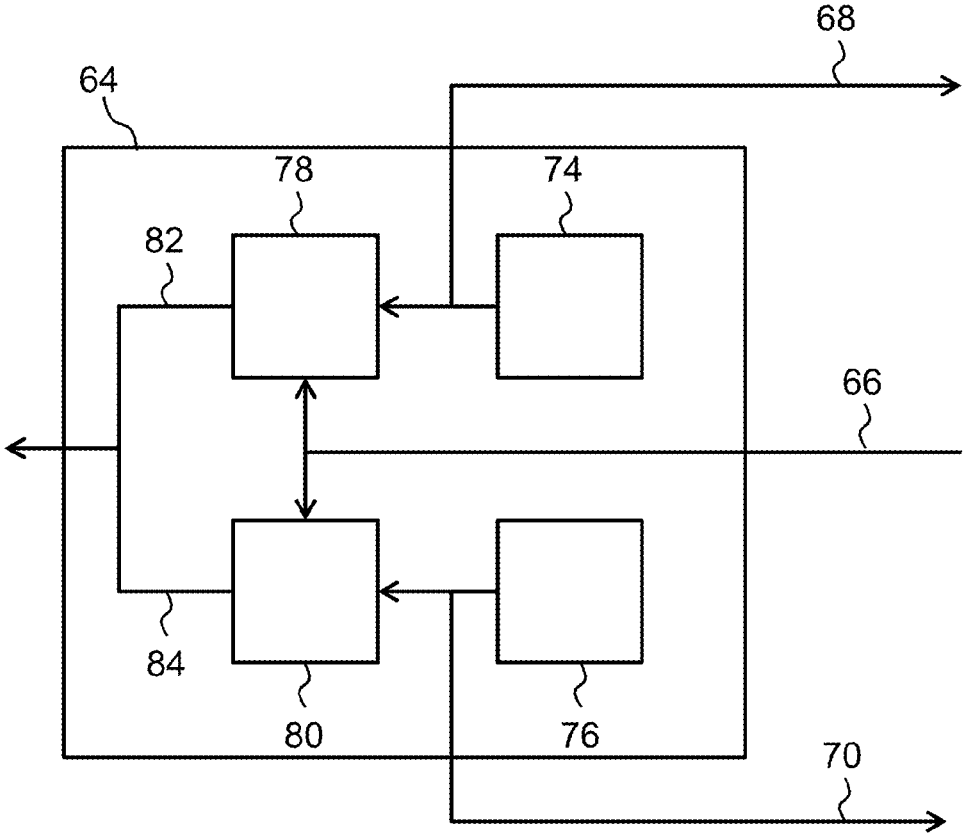

FIG. 2 schematically illustrates an exemplary processing unit 64 for an exemplary apparatus 50 for testing a directional hearing instrument 2. The processing unit 64 comprises: a first tone generator 74, a second tone generator 76, a first cross spectrum analyzer 78, and a second cross spectrum analyzer 80. The first tone generator 74 provides the first speaker signal 68 indicative of the first signal 56 to the first speaker 54 and the first cross spectrum analyzer 78. The second tone generator 76 provides the second speaker signal 70 indicative of the second signal 60 to the second speaker 58 and the second cross spectrum analyzer 80. The first cross spectrum analyzer 78 and the second cross spectrum analyzer 80 furthermore receive the input signal 66 indicative of the audio output signal 5.

The first cross spectrum analyzer 78 determines one or more hearing instrument parameters based on cross spectrum analysis of the first signal 56 and the audio output signal 5. The cross spectrum analysis of the first signal 56 and the audio output signal 5 may be based on the first speaker signal 68 indicative of the first signal 56 and the input signal 66 indicative of the audio output signal 5. The first cross spectrum analyzer 78 provides a first analyzer output 82 comprising the determined one or more hearing instrument parameters, such as a first transfer function or a first cross spectrum function of the first signal 56 and the audio output signal 5.

The second cross spectrum analyzer 80 determines one or more hearing instrument parameters based on cross spectrum analysis of the second signal 60 and the audio output signal 5. The cross spectrum analysis of the second signal 60 and the audio output signal 5 may be based on the second speaker signal 70 indicative of the second signal 60 and the input signal 66 indicative of the audio output signal 5. The second cross spectrum analyzer 80 provides a second analyzer output 84 comprising the determined one or more hearing instrument parameters, such as a second transfer function or a second cross spectrum function of the second signal 56 and the audio output signal 5.

The first analyzer output 82 and the second analyzer output 84 may be provided to the interface 72 and/or a second processing unit. The first analyzer output 82 and the second analyzer output 84 may be combined to form a processing unit output, i.e. the first analyzer output 82 and the second analyzer output 84 may be combined to determine a front-to-back ratio of the hearing instrument 2. Alternatively and/or additionally, the first analyzer output 82 and the second analyzer output 84 may be provided individually.

Figure 3:
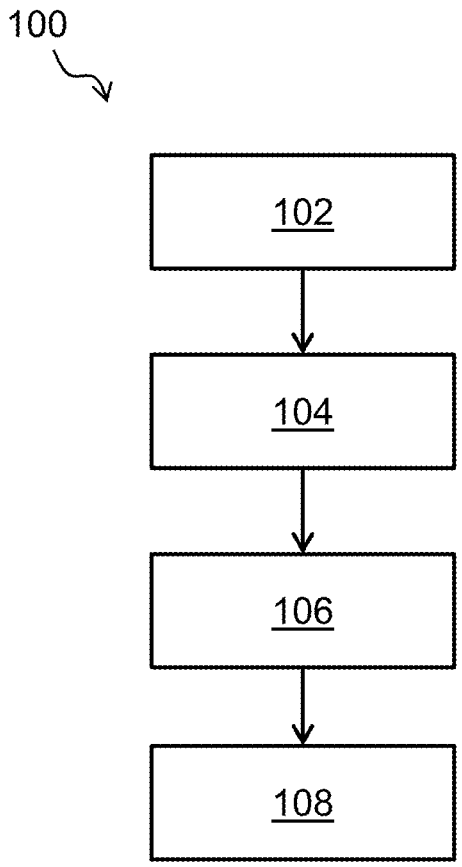
FIG. 3 shows a flow diagram of an exemplary method for testing a directional hearing instrument.

FIG. 3 shows a flow diagram of an exemplary method 100 for testing a directional hearing instrument 2. The method comprises: transmitting 102 a first signal 56 through a first speaker 54; transmitting 104 a second signal 60 through a second speaker; receiving 106 an audio output signal 5 from the hearing instrument 2; and determining 108 one or more hearing instrument parameters based on the first signal 56 and the audio output signal 5.

The first signal 56 has a first frequency component at a first frequency. The second signal 60 has a second frequency component at a second frequency. The first frequency and the second frequency may be substantially the same frequency and/or the difference between the first frequency and the second frequency may be less than 10 Hz, such as less than 5 Hz, such as less than 2 Hz.

Determining 108 one or more hearing instrument parameters is based on cross spectrum analysis of the first signal 56 and the audio output signal 5. Additionally, determining 108 one or more hearing instrument parameters may be based on cross spectrum analysis of the second signal 60 and the audio output signal 5.

Transmitting 102 the first signal 56 and transmitting 104 the second signal 60 may be interchanged and/or performed simultaneously. Transmitting 102 the first signal 56 and transmitting 104 the second signal 60 may be performed simultaneously to resemble a natural occurring situation e.g. a situation comprising speech from a front direction and noise from a rear direction.

The one or more hearing instrument parameters may comprise a first hearing instrument parameter. The first hearing instrument parameter may be a function of frequency. The first hearing instrument parameter may be a front-to-back ratio, e.g. a ratio of the first signal 56 and the second signal 60. The front-to-back ratio may be based on a first transfer function and a second transfer function. The first transfer function may be based on the first signal 56 and the audio output signal 5, e.g. based on cross spectrum analysis of the first signal 56 and the audio output signal 5. The second transfer function may be based on the second signal 60 and the audio output signal 5, e.g. based on cross spectrum analysis of the second signal 60 and the audio output signal 5.

The determining 108 of the one or more hearing instrument parameters, such as the first hearing instrument parameter, such as the front-to-back-ratio, may comprise determining the first transfer function based on cross spectrum analysis of the first signal 56 and the audio output signal 5, determining the second transfer function based on cross spectrum analysis of the second signal 60 and the audio output signal 5, and determining a ratio of the first transfer function and the second transfer function.

The method 100, or parts of the method 100, may be implemented in an apparatus such as the apparatus 50 for testing a directional hearing instrument. Alternatively and/or additionally the method 100, or parts of the method 100, may be implemented in a processing unit, such as the apparatus processing unit 64 of an apparatus 50 for testing a directional hearing instrument 2. Alternatively and/or additionally, the method 100, or part of the method 100, may be implemented in software adapted to be executed in a processing unit, e.g. a processing unit of a personal computer, a laptop, a smartphone, or a tablet computer. Particularly, the determining 108 of the one or more hearing instrument parameters may be implemented in a processing unit and/or in software adapted to be executed in a processing unit.

One or more hearing instrument parameters may comprise a first transfer function, such as a first transfer function between the first signal and the audio output signal, a second transfer function, such as a second transfer function between the second signal and the audio output signal, and/or a front-to-back ratio, such as a front-to-back ratio between the first transfer function and the second transfer function. All of these functions may be a function of frequency (f).

In an exemplary method and/or apparatus, the first transfer function may be determined by:

determining a first cross spectrum function ($G_{1,O}(f)$) between the first signal ($x_1$) and the audio output signal ($y_O$) by cross spectrum analysis of the first signal and the audio output signal, determining a first power spectrum function ($G_{1,1}(f)$) of the first signal, and determining the first transfer function ($H_1(f)$) of the first signal and the audio output signal based on the first cross spectrum function and the first power spectrum function, e.g. a ratio of the first cross spectrum function and the first power spectrum function:

$$H_1(f) = \frac{G_{1,O}(f)}{G_{1,1}(f)}$$

In an exemplary method and/or apparatus, the first signal ($x_1$) may be a front signal, and/or the first transfer function may be a front-to-output frequency response for the hearing instrument.

The second transfer function may be determined by:

determining a second cross spectrum function ($G_{2,O}(f)$) between the second signal ($x_2$) and the audio output signal ($y_O$) by cross spectrum analysis of the second signal and the audio output signal, determining a second power spectrum function ($G_{2,2}(f)$) of the second signal, and determining the second transfer function ($H_2(f)$) of the second signal and the audio output signal based on the second cross spectrum function and the second power spectrum function, e.g. a ratio of the second cross spectrum function and the second power spectrum function:

$$H_2(f) = \frac{G_{2,O}(f)}{G_{2,2}(f)}$$

In an exemplary method and/or apparatus, the second signal ($x_2$) may be a rear signal, and/or the second transfer function may be a rear-to-output frequency response for the hearing instrument.

The front-to-back ratio (FB(f)) may be determined based on the first transfer function and the second transfer function and/or based on the first and second cross spectrums and the first and second power spectrums, e.g.:

$$FB(f) = \frac{H_1(f)}{H_2(f)} = \frac{G_{1,O}(f) \cdot G_{2,2}(f)}{G_{1,1}(f) \cdot G_{2,O}(f)}$$

Several algorithms may be used to compute one or more of $G_{1,1}(f)$, $G_{1,O}(f)$, $H_1(f)$, $G_{2,2}(f)$, $G_{2,O}(f)$, $H_2(f)$. For example, Welch's method and/or Bartlett's method may be used to compute cross spectrum functions and/or power spectrum functions.

These methods determine cross spectrum functions and/or power spectrum functions by averaging cross spectrum functions and/or power spectrum functions of short segments of the original signals. For example, calculation of the first cross spectrum function, the original signals are divided into short segments . . . k−1, k, k+1, . . . . For each segment, a Fourier transform is performed for each signal, and the two Fourier transforms representing segment k of the original signals are combined to obtain a segment cross spectrum for segment k:

$$G_{1,O,k}(f) = X_{1,k}(f) \cdot Y^*_{O,k}(f)$$

Wherein $X_{1,k}(f)$ is the first Fourier transform of the $k^{th}$ segment of the first signal ($x_1$). * denotes the complex conjugate. Hence, $Y^*_{O,k}(f)$ is the complex conjugate of the output Fourier transform of the $k^{th}$ segment of the audio output signal ($y_O$).

$G_{1,O}$ is calculated by averaging the segment cross spectrums:

$$G_{1,O}(f) = \frac{1}{n}\sum_{i=1}^{n} G_{1,O,i}(f) = \frac{1}{n}\sum_{i=1}^{n} X_{1,i}(f) \cdot Y^*_{O,i}(f),$$

wherein n is the total number of segments. Similarly $G_{1,1}(f)$, $G_{2,2}(f)$, $G_{2,O}(f)$ may be found:

$$G_{1,1}(f) = \frac{1}{n}\sum_{i=1}^{n} X_{1,i}(f) \cdot X^*_{1,i}(f)$$

$$G_{2,2}(f) = \frac{1}{n}\sum_{i=1}^{n} X_{2,i}(f) \cdot X^*_{2,i}(f)$$

$$G_{2,O}(f) = \frac{1}{n}\sum_{i=1}^{n} X_{2,i}(f) \cdot Y^*_{O,1}(f),$$

where * denotes the complex conjugate.

Figure 4:
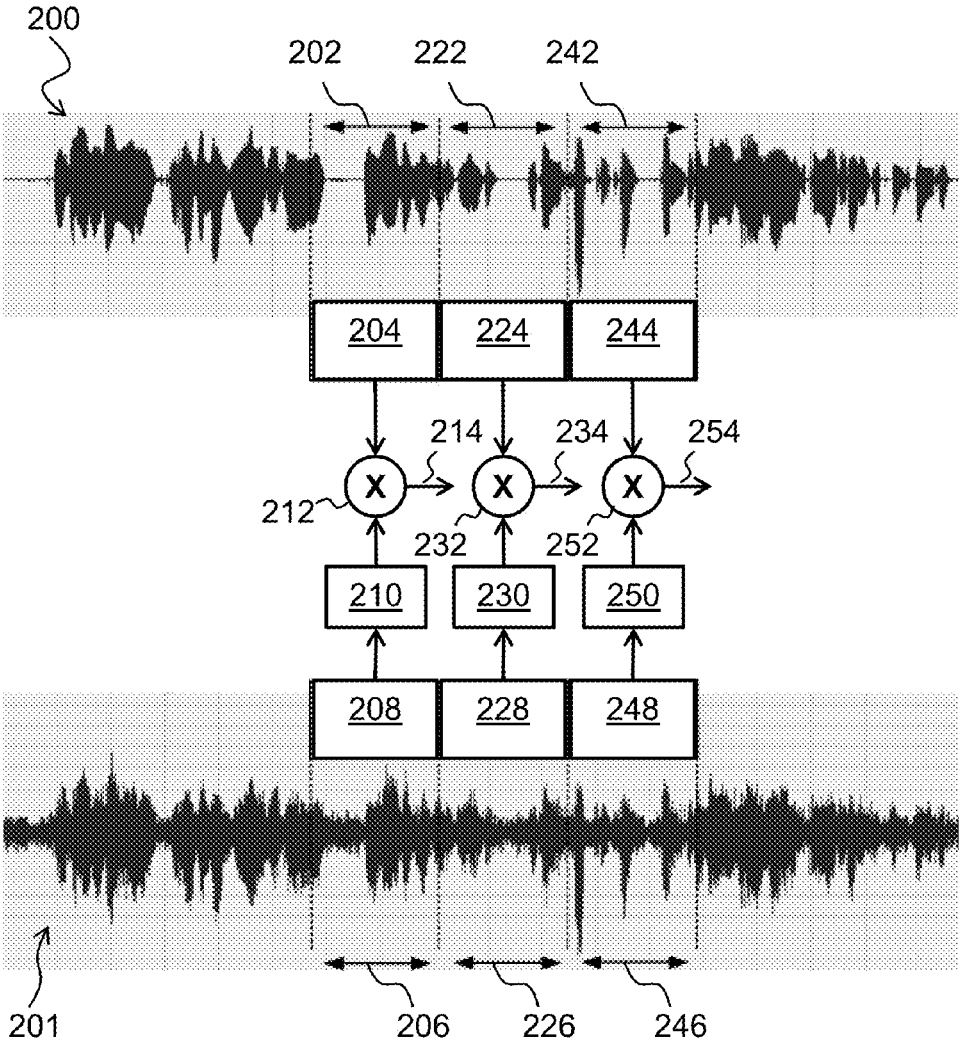
FIG. 4 shows an illustrative example of determining the first cross spectrum function.

FIG. 4 shows an illustrative example of determining the first cross spectrum function $G_{1,O}$ from the first signal 200 and the second signal 201. The first signal 200 is divided in a plurality of segments 202, 222, 242, e.g. corresponding to the segments k−1, k, and k+1 above.

To obtain the k−1 segment cross spectrum $G_{1,O,k}$, the k−1 segment 202 of the first signal 200 is Fourier transformed 204 and multiplied 212 with the k−1 segment 206 of the second signal 201 being Fourier transformed 208 and complex conjugated 210.

To obtain the k segment cross spectrum $G_{1,O,k}$, the k segment 222 of the first signal 200 is Fourier transformed 224 and multiplied 232 with the k segment 226 of the second signal 201 being Fourier transformed 228 and complex conjugated 230.

To obtain the k+1 segment cross spectrum $G_{1,O,k+1}$, the k+1 segment 242 of the first signal 200 is Fourier transformed 244 and multiplied 252 with the k+1 segment 246 of the second signal 201 being Fourier transformed 248 and complex conjugated 250.

The resulting segment cross spectrums 214, 234, 254 may be averaged or weighted to find the first cross spectrum function $G_{1,O}$.

The present method allows obtaining the transfer functions $H_1(f)$ and $H_2(f)$ and frequency responses for the hearing instrument, even in the presence of other signals which may act as a disturbance to the measurement procedure, such as the rear signal, e.g. the second signal, in front-to-output calculations, and as the front signal, e.g. the first signal, in rear-to-output calculations.

In events of the first signal and the second signal being very different, e.g. in contents of frequency components and/or time variation, a reliable estimate of the cross spectrum functions ($G_{1,2}$ and $G_{2,1}$) may be obtained from a relatively short sample, i.e. a few number of segments. Conversely, in events of the first signal and the second signal being less different, e.g. in contents of frequency components and/or time variation, a reliable estimate of the cross spectrum functions ($G_{1,2}$ and $G_{2,1}$) may require a longer sample, i.e. an increased number of segments.

The Fourier transformations above may be determined using discrete Fourier transformation (DFT), such as the Fast Fourier Transformation (FFT).

Figure 5:
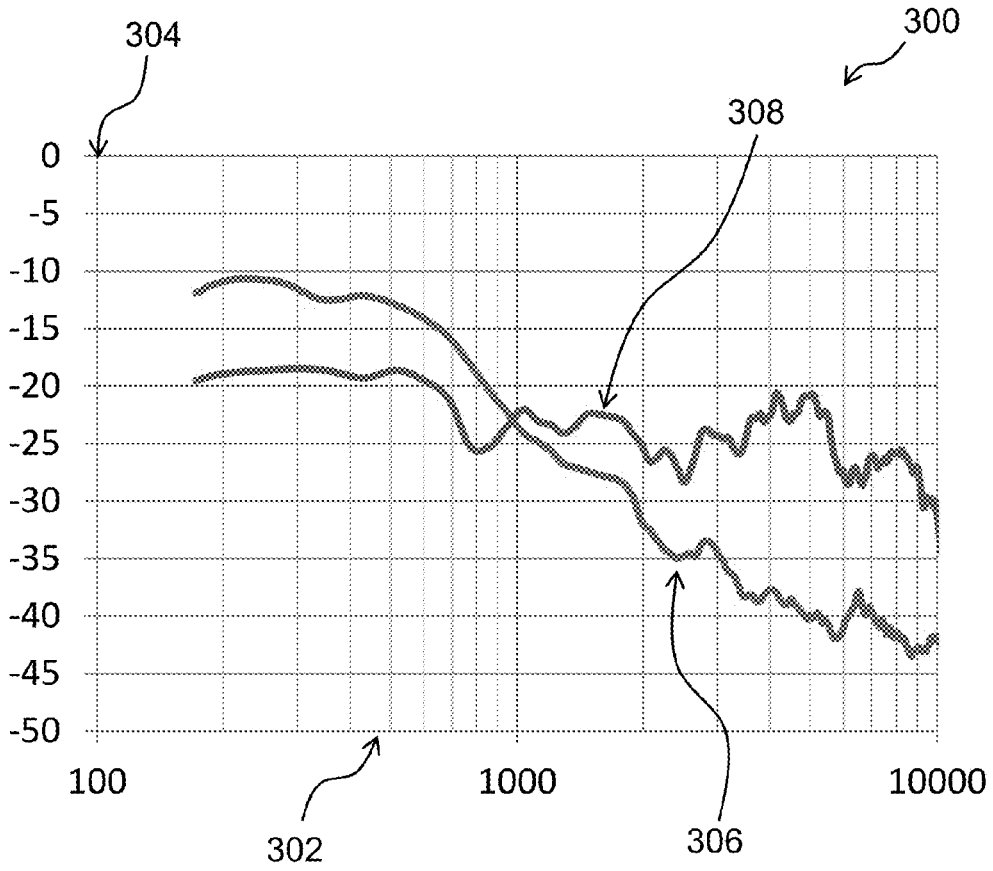
FIG. 5 shows an example of power spectrums of an exemplary first signal and an exemplary second signal.

FIG. 5 shows a simulated example of power spectra 300 of an exemplary first signal 306 and an exemplary second signal 308. The power spectra 300 are shown in a diagram having a first logarithmic axis 302 with units of Hz, and a second axis 304 with units of dB. In the exemplary power spectra 300 the first signal 306 being a speech signal and the second signal 308 is a noise signal. It is seen that the second signal 308 comprises more power in higher frequencies than the first signal 306. Also seen is that the first signal 306 and the second signal 308 comprise overlapping frequencies. E.g. the power of the first signal 306 between 900 Hz and 1000 Hz is approximately similar to the power of the second signal 308 between 900 Hz and 1000 Hz.

Figure 6:
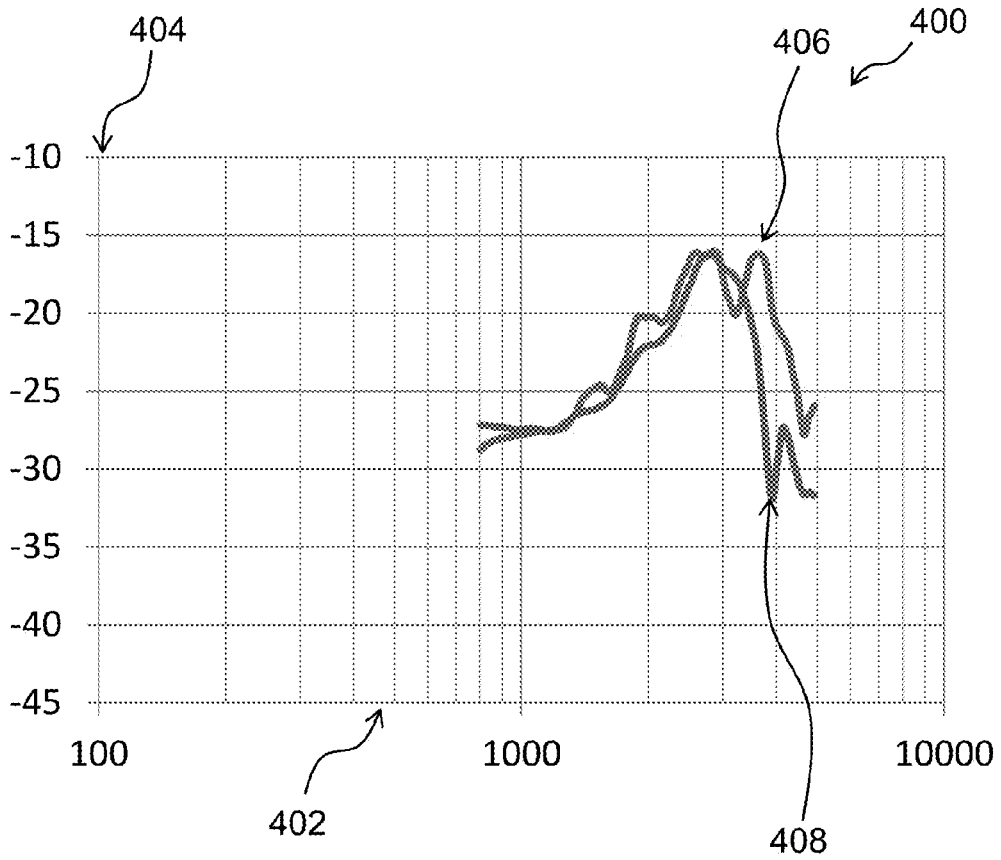
FIG. 6 shows an example of exemplary hearing instrument parameters obtained from testing a hearing instrument operating in an omni-directional mode.

FIG. 6 shows an example of exemplary hearing instrument parameters 400 obtained from testing a hearing instrument operating in an omni-directional mode. The exemplary hearing instrument parameters 400 are shown in a diagram having a first logarithmic axis 402 with units of Hz, and a second axis 404 with units of dB. The first hearing instrument parameter 406 shows an obtained first transfer function, in this example a front-to-output frequency response for the hearing instrument. The second hearing instrument parameter 408 shows an obtained second transfer function, in this example, a rear-to-output frequency response for the hearing instrument. It is seen that, when operating in an omni-directional mode, the front-to-output frequency response 406 and the rear-to-output frequency response 408 are substantially equivalent. Hence, the hearing instrument performs as intended in the omni-directional mode.

Figure 7:
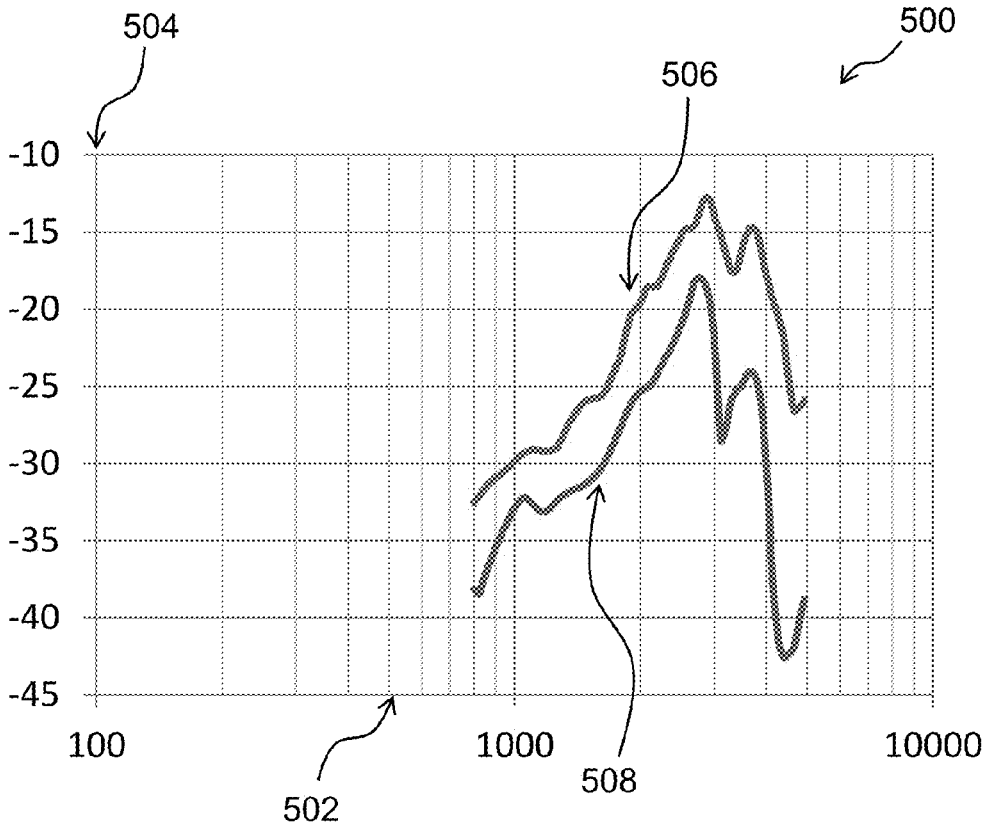
FIG. 7 shows an example of exemplary hearing instrument parameters obtained from testing a hearing instrument operating in a directional mode.

FIG. 7 shows an example of exemplary hearing instrument parameters 500 obtained from testing a hearing instrument operating in a directional mode. The exemplary hearing instrument parameters 500 are shown in a diagram having a first logarithmic axis 502 with units of Hz, and a second axis 504 with units of dB. The first hearing instrument parameter 506 shows an obtained first transfer function, in this example a front-to-output frequency response for the hearing instrument. The second hearing instrument parameter 508 shows an obtained second transfer function, in this example, a rear-to-output frequency response for the hearing instrument. It is seen that, when operating in a directional mode, the front-to-output frequency response 506 and the rear-to-output frequency response 508 differ substantially, and in particular they differ comparing with the results for the omni-directional mode as illustrated in FIG. 6. Hence, the hearing instrument performs as intended in the directional mode.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications and equivalents.

Apparatuses and methods are disclosed in the following items:

Item 1. An apparatus for testing a directional hearing instrument, the apparatus comprising:

a first microphone for coupling with an output of the hearing instrument, wherein the first microphone is configured to receive an audio output signal from the hearing instrument, a first speaker for transmission of a first signal, the first signal having a first frequency component at a first frequency, a second speaker for transmission of a second signal, the second signal having a second frequency component at a second frequency, and a processing unit configured to determine one or more hearing instrument parameters based on cross spectrum analysis of the first signal and the audio output signal.

Item 2. Apparatus according to item 1, wherein the processing unit is configured to determine one or more hearing instrument parameters based on cross spectrum analysis of the second signal and the audio output signal.

Item 3. Apparatus according to any of items 1-2, wherein the difference between the first frequency and the second frequency is less than 10 Hz.

Item 4. Apparatus according to any of the preceding items, wherein the one or more hearing instrument parameters comprises a first hearing instrument parameter being a front-to-back ratio.

Item 5. Apparatus according to any of the preceding items, wherein a relationship between the first frequency component (dBSPL) and the second frequency component (dBSPL) is in the range from 0.2 to 5.

Item 6. Apparatus according to any of the preceding items, wherein the one or more hearing instrument parameters comprise a first transfer function based on the first signal and the audio output signal.

Item 7. Apparatus according to any of the preceding items, wherein the one or more hearing instrument parameters comprises a second transfer function based on the second signal and the audio output signal.

Item 8. Apparatus according to any of the preceding items, wherein the processing unit is configured to perform a dual channel DFT of the first signal and the audio output signal and/or of the second signal and the audio output signal.

Item 9. Apparatus according to any of the preceding items, wherein the first signal and the second signal are at least partly separate in time.

Item 10. Apparatus according to any of the preceding items, wherein the first signal is an International Speech Test Signal.

Item 11. Method for testing a directional hearing instrument, the method comprising:

transmitting a first signal through a first speaker the first signal having a first frequency component at a first frequency;

transmitting a second signal through a second speaker the second signal having a second frequency component at a second frequency;

receiving an audio output signal from the hearing instrument; and determining one or more hearing instrument parameters based on cross spectrum analysis of the first signal and the audio output signal.

Item 12. Method according to item 11, wherein determining one or more hearing instrument parameters are based on cross spectrum analysis of the second signal and the audio output signal Item 13. Method according to any of items 11-12, wherein the difference between the first frequency and the second frequency is less than 10 Hz.

Item 14. Method according to any of items 11-13, wherein the one or more hearing instrument parameters comprises a first hearing instrument parameter being a front-to-back ratio.

Item 15. Method according to item 14, wherein the front-to-back ratio is based on a first transfer function and a second transfer function, wherein the first transfer function is based on the first signal and the audio output signal and the second transfer function is based on the second signal and the audio output signal.

LIST OF REFERENCES

2 hearing instrument
4 output
5 audio output signal
6 first input transducer
8 second input transducer
10 hearing instrument processing unit
12 hearing instrument housing
50 apparatus
52 first microphone
54 first speaker
56 first signal
58 second speaker
60 second signal
62 apparatus housing
64 apparatus processing unit
66 input signal
68 first speaker signal
70 second speaker signal
72 interface
74 first tone generator
76 second tone generator
78 first cross spectrum analyzer
80 second cross spectrum analyzer
82 first analyzer output
84 second analyzer output
100 method for testing a directional hearing instrument
102 transmit first signal
104 transmit second signal
106 receive audio output signal
108 determine hearing instrument parameters

The invention claimed is:

1. An apparatus for testing a directional hearing instrument, comprising:

a first microphone for coupling with an output of the hearing instrument, wherein the first microphone is configured to receive an audio output signal from the hearing instrument;

a first speaker for transmission of a first signal having a first frequency component at a first frequency;

a second speaker for transmission of a second signal having a second frequency component at a second frequency; and a processing unit configured to determine one or more hearing instrument parameters based on cross spectrum analysis of the audio output signal and at least one of said first and second signal;

wherein the first signal and the second signal are input for the hearing instrument.

2. The apparatus according to claim 1, wherein the processing unit is configured to determine the one or more hearing instrument parameters also based on cross spectrum analysis of the first and second signal and the audio output signal.

3. The apparatus according to claim 1, wherein a difference between the first frequency and the second frequency is less than 10 Hz.

4. The apparatus according to claim 1, wherein the one or more hearing instrument parameters comprise a first hearing instrument parameter, the first hearing instrument parameter being a front-to-back ratio.

5. The apparatus according to claim 1, wherein the one or more hearing instrument parameters comprise a first transfer function that is based on the first signal and the audio output signal.

6. The apparatus according to claim 5, wherein the one or more hearing instrument parameters comprise a second transfer function that is based on the second signal and the audio output signal.

7. The apparatus according to claim 1, wherein the processing unit is configured to perform a dual channel discrete Fourier transformation (DFT) of the at least one said first and second signal and the audio output signal.

8. The apparatus according to claim 1, wherein the first signal and the second signal are at least partly separate in time.

9. The apparatus according to claim 1, wherein the first signal comprises an International Speech Test Signal.

10. The apparatus according to claim 1, wherein the processing unit is configured to utilize the first and second signals simultaneously.

11. An apparatus for testing a directional hearing instrument, comprising:

a first microphone for coupling with an output of the hearing instrument, wherein the first microphone is configured to receive an audio output signal from the hearing instrument;

a first speaker for transmission of a first signal having a first frequency component at a first frequency;

a second speaker for transmission of a second signal having a second frequency component at a second frequency; and a processing unit configured to determine one or more hearing instrument parameters based on cross spectrum analysis of the first signal and the audio output signal;

wherein a ratio or a difference between the first frequency component of the first signal and the second frequency component of the second signal is anywhere from 0.2 to 5, and wherein the first signal and the second signal are input for the hearing instrument.

12. A method for testing a directional hearing instrument, comprising:

transmitting a first signal through a first speaker, the first signal having a first frequency component at a first frequency;

transmitting a second signal through a second speaker, the second signal having a second frequency component at a second frequency;

receiving an audio output signal from the hearing instrument; and determining one or more hearing instrument parameters based on cross spectrum analysis of the audio output signal and at least one of said first and second signal;

wherein the first signal and the second signal are input for the hearing instrument.

13. The method according to claim 12, wherein the one or more hearing instrument parameters are determined based on cross spectrum analysis first and second signal and the audio output signal.

14. The method according to claim 12, wherein a difference between the first frequency and the second frequency is less than 10 Hz.

15. The method according to claim 12, wherein the one or more hearing instrument parameters comprise a first hearing instrument parameter, the first hearing instrument parameter being a front-to-back ratio.

16. The method according to claim 15, wherein the front-to-back ratio is based on a first transfer function and a second transfer function, wherein the first transfer function is based on the first signal and the audio output signal, and the second transfer function is based on the second signal and the audio output signal.

17. The method of claim 12, wherein wherein the first signal and the second signal are at least partly separate in time.

18. The method of claim 12, wherein the act of determining is performed by a processing unit that utilizes sim the first and second signals simultaneously.

19. An apparatus for testing a directional hearing instrument, comprising:

a first microphone for coupling with an output of the hearing instrument, wherein the first microphone is configured to receive an audio output signal from the hearing instrument;

a first speaker for transmission of a first signal having a first frequency component at a first frequency;

a second speaker for transmission of a second signal having a second frequency component at a second frequency, wherein the first signal and the second signal are input for the hearing instrument; and a processing unit configured to determine based on cross spectrum analysis signal contributions from the first signal and the second signal as they appear in the audio output signal from the hearing instrument.

20. The apparatus according to claim 19, wherein the processing unit is configured to utilize the first and second signals simultaneously.

21. The apparatus according to claim 19, wherein the processing unit is configured to perform a cross spectrum analysis of the audio output signal and at least one of said first and second signal.

* * * * *